US008882473B2

(12) United States Patent
Gandhi et al.

(10) Patent No.: US 8,882,473 B2
(45) Date of Patent: Nov. 11, 2014

(54) LIQUID DISPENSER

(75) Inventors: Shirish R. Gandhi, Maharashtra (IN); Milind A. Joshi, Maharashtra (IN)

(73) Assignee: Spirax Marshall Pvt. Ltd., Maharashtra (IN)

( * ) Notice: Subject to any disclaimer, the term of this patent is extended or adjusted under 35 U.S.C. 154(b) by 300 days.

(21) Appl. No.: 13/379,279

(22) PCT Filed: Jun. 10, 2010

(86) PCT No.: PCT/GB2010/050978
§ 371 (c)(1),
(2), (4) Date: Feb. 27, 2012

(87) PCT Pub. No.: WO2010/146385
PCT Pub. Date: Dec. 23, 2010

(65) Prior Publication Data

US 2012/0148422 A1 Jun. 14, 2012

(30) Foreign Application Priority Data

Jun. 17, 2009 (IN) ..... 1445/MUM/2009A

(51) Int. Cl.
*F04F 1/06* (2006.01)

(52) U.S. Cl.
CPC ..... *F04F 1/06* (2013.01)
USPC ..... 417/126; 417/130; 417/132; 417/133

(58) Field of Classification Search
USPC ..... 417/126–136
See application file for complete search history.

(56) References Cited

U.S. PATENT DOCUMENTS

| | | | | |
|---|---|---|---|---|
| 1,699,464 | A | 1/1929 | Dutcher | |
| 2,612,118 | A | 9/1952 | Harvie | |
| 3,972,650 | A * | 8/1976 | Brennan | 417/128 |
| 5,141,405 | A | 8/1992 | Francart, Jr. | |
| 5,230,361 | A | 7/1993 | Carr et al. | |

(Continued)

FOREIGN PATENT DOCUMENTS

| | | |
|---|---|---|
| FR | 1477455 A | 4/1967 |
| GB | 2302916 | 2/1997 |
| GB | 2302917 A | 2/1997 |

OTHER PUBLICATIONS

International Patent Application No. PCT/GB2010/050978 International Search Report dated Nov. 11, 2010.

*Primary Examiner* — Charles Freay
*Assistant Examiner* — Patrick Hamo
(74) *Attorney, Agent, or Firm* — Banner & Witcoff, Ltd.

(57) ABSTRACT

A liquid dispensing mechanism adapted to achieve an increased inflow and an increased outflow rate and consisting of an inlet line adapted to receive liquid from an external reservoir, and adapted to release aid liquid via an outlet line, said mechanism comprising a pressure chamber adapted to store liquid and provide liquid level to fall or rise as a function of pressure, before release; a buffer chamber adapted to connect with said pressure chamber by means of non-return valves, and further adapted to store liquid before it flows into said pressure chamber, in order to increase flow coefficient of inlet line; float member in said pressure chamber, adapted to sense level of liquid in said pressure chamber by means of position of said float member; multiple valve actuator assembly adapted to actuate a pre-defined configuration of valves, with a time-delay between engaging or disengaging subsequent valves, for controlled engaging or disengaging pressure in a predetermined format; snap action valve actuating mechanism comprising fastener elements adapted to actuate said multiple valve actuator assembly in correlation with position of said float member.

17 Claims, 6 Drawing Sheets

(56) References Cited

U.S. PATENT DOCUMENTS 5,366,349 A 11/1994 Ilg
5,525,042 A * 6/1996 Batten ..... 417/113
5,938,409 A * 8/1999 Radle et al. ..... 417/133
6,174,138 B1 1/2001 Stephens
6,602,056 B1 8/2003 Totten
6,935,844 B1 8/2005 Dukes et al.

* cited by examiner

LIQUID DISPENSER

CROSS-REFERENCE TO RELATED APPLICATIONS

The present application is a U.S. National Phase filing of International Application No. PCT/GB2010/050978, filed Jun. 10, 2010, which claims priority of India Patent Application No. 1445/MUM/2009A, filed Jun. 17, 2009. Benefit of the filing date of each of these prior applications is hereby claimed. Each of these prior applications is hereby incorporated by reference in their entirety for any and all non-limiting purposes.

FIELD

This invention relates to liquid dispensers.

Particularly, this invention relates to pumps for liquid.

BACKGROUND

Most of the process plants use steam for different heating applications, as it is one of the cheapest and effective media for heating applications. Once the steam is used in process heating application it gets converted to condensate. Often it is necessary to pump this condensate (from heating equipment located at different locations in the plant), back to the feed water tank in the boiler house. Making the most out of the Energy in steam system is the key to efficient operation. Yet, industries may be pouring useful of heat energy down through drains with the condensate that is being discharged from steam traps. It is not enough to simply remove the condensate from steam system; the true benefits come from adopting a simple condensate recovery.

Condensate Recovery

Condensate recovery enables to reclaim the condensate that is routinely discharged from steam traps by re-circulating it to boiler for use in producing additional steam. By doing this, one will find savings in a number of areas, such as:

Recapturing lost heat energy—instead of losing the usable Energy in the condensate, re-circulate them to the return to main and boiler feed water system for use in producing additional steam.

Lowering make-up costs—returning hot condensate not only conserves energy, it also lowers costs for preheating boiler make-up water.

Reducing operating costs—instead of sending treated water down the drain, a condensate recovery system will return it to the boiler where it will be re-used without requiring additional treatment chemicals.

Methods of Condensate Recovery:

1. Centrifugal Pump:

Some plants use electric pumps for pumping the condensate. However, condensate is often hot at temperature greater than 100° C., which gives rise to Cavitation of the pump/impeller. (Centrifugal pumps generate lower pressure behind the impeller. The hot condensate temporarily evaporates and expands on the back side of the vanes). Over a period of time this will cause erosion and reduce the life of pump impeller.

2. Pressure Powered Pump:

Pressure powered pump is a positive displacement pump operated by pressurized steam or pressurized air or pressurized gas for pumping the condensate back to the feed water tank. Pressure Powered Pumps (hereafter referred as PPP) are designed to move condensate without the use of electricity, and return condensate at high temperatures which is a limitation in case of typical conventional electric pumps (This limit is due to the fact, that above this temperature Cavitation occurs at the eye of impeller of centrifugal pumps, which damages impeller and pump body and badly affects pump operation). Since PPP are pressure-operated, they require no electrical panels, starters or accessories.

Liquid dispensers powered by gas pressure, especially steam pressure, have a number of benefits for liquid dispensing system. Such liquid dispensers can operate under various conditions of pressure or vacuum and do not require seals or packing as do liquid dispensers powered by rotary machines or having pistons or centrifugal impellers.

Pressure driven liquid dispensers consume a minimal amount of power and generally provide a durable and cost effective solution to liquid pumping needs in various situations. A typical liquid dispenser driven by gas pressure comprises a tank having a liquid inlet and a liquid outlet near the bottom of the tank, with an inlet check valve and an outlet check valve permitting flow only in the liquid pumping direction. The tank also has a gas inlet and a gas exhaust outlet located higher on the tank, above the maximum liquid level. The gas inlet and gas outlet have valves that are operated reciprocally, such that the gas or pressure inlet is open when the gas outlet or exhaust is closed, and vice versa, as a function of the level of liquid in the liquid dispenser tank.

For example, the gas inlet valve and gas outlet valve can be coupled to a float mechanism. Alternatively, the liquid level in the tank can be sensed by electrical level sensors that produce a signal for triggering the gas or pressure inlet/outlet valves to reverse positions. The operation requires a certain hysteresis, with the gas inlet opening and exhaust closing when the fluid level reaches a high threshold level, and remaining in that position until reversing when the fluid level drops below a low threshold. The difference between the thresholds, which can be sensed in a variety of ways, defines the stroke of the liquid dispenser.

One arrangement in which the liquid level is sensed using a float and the valves are operated mechanically, involves a snap action linkage that simultaneously opens the gas inlet and closes the gas outlet, or closes the gas inlet and opens the gas outlet, at the two thresholds. Examples of such snap action float mechanisms and liquid dispensers are disclosed in U.S. Pat. No. 5,230,361-Carr et al.; U.S. Pat. No. 5,366,349—fig; U.S. Pat. No. 5,141,405—Francart, Jr.; and U.S. Pat. No. 1,699,464—Dutcher.

In other arrangement a pressure powered pump wherein float being operatively connected to a spring-loaded over-center mechanism includes valve actuating means acting on the valve elements which is movable between defined positions, by stop means for arresting movement of the valve actuating means in the stable positions as in European patent GB 2302916; a float operated device for a pressure powered pump where float operates a toggle mechanism composed of an input lever carrying a float, and an output lever, the levers pivotably mounted at spaced locations on a common support, a resilient means act between said levers and said resilient means acts to bias the output lever into the other of its limit positions as in U.S. Pat. No. 6,174,138 and a pump with spring assisted float mechanism, an over-center snap-action mechanism mechanically linked to the ball check valve assembly as in U.S. Pat. No. 6,602,056.

The liquid dispenser has a cycle including a liquid filling phase, pressurizing/pumping phase and a depressurizing phase. During the liquid filling phase the gas inlet is closed, the gas outlet is open, and the liquid, which can be water or some other liquid, flows at a relatively low pressure through the liquid inlet check valve to fill the tank. This filling flow can be powered by gravity or another form of low pressure flow. The liquid outlet check valve remains closed because the pressure of the liquid in the tank is relatively low. Tank pressure is low because the gas exhaust valve is open, and the flow line downstream of the outlet check valve may be pressurized as well, either of which keeps the outlet check valve closed. The exhaust valve may vent into the atmosphere, or it may vent into a closed conduit or vessel at a pressure less than the liquid inlet head.

As the float rises in the tank with the level of liquid, the float mechanism reaches a crossover point and toggles the gas valves to open the gas inlet and close the gas outlet, switching from the liquid filling phase of the cycle to the liquid discharge phase. Gas under pressure, such as steam, pressurizes the tank through the gas inlet valve, the gas outlet valve now being closed. Gas pressure builds in the tank; reverse biases the liquid inlet check valve, and forward biases the liquid outlet check valve. The liquid in the tank is forced by gas pressure through the liquid outlet check valve and downstream of the liquid dispenser, at the pressure of the steam or other gas. When the float drops past a low crossover point, the gas inlet valve closes and the gas outlet valve opens, venting the pressure in the tank and permitting the cycle to repeat.

In this manner the tank alternately fills with low pressure liquid and discharges at higher pressure through the liquid outlet. The liquid dispenser is useful for returning or inserting liquid such as water into a pressurized system using the pressure in the system as the motive pressure force. This is particularly useful in connection with steam power and heat exchange systems. However, all that is needed is a pressure differential. Thus, the liquid dispenser is useful in closed loop arrangement in which one or more of the inlet liquid feed to the tank, the gas exhaust from the tank and the outlet, are at elevated pressure as compared to-ambient.

Although a pressure liquid dispenser as described is durable and useful, there are certain limitations inherent in its structure, resulting in limitations on the flow or liquid dispensing capacity of the liquid dispenser. In as much as liquid filling typically is accomplished at low differential pressure (e.g., by gravity) through isolation valve, strainer and non-return valve, the liquid fill rates are too slow. During pumping phase, pressurized media at sufficient pressure and flow is must, as it initially spread in pressure chamber and then starts the pressurizing of the liquid in pressure chamber, this increases pumping phase time. This time depends on flow rate, port size of pressurizing port and pressure and flow rate of the pressurizing media. When switching from the pressurized pumping phase to the vented exhaust stage, time is required to permit the gas pressure in the tank to vent before low pressure liquid can begin to fill the tank through the liquid inlet check valve. The time taken to reduce the internal tank pressure to a lower pressure than the inlet line depends on several factors including the extent to which the tank was pressurized and the internal diameter and back pressure of the gas exhaust valve and conduit. The need to vent and reduce tank pressure to shift from positive to negative pressure differentials between the tank and the liquid inlet (to open the inlet check valve and allow an in-flow) and between the tank and the liquid outlet (to close the outlet check valve), respectively, provide an inherent cycling delay and a corresponding limitation on the flow rate of the liquid dispenser.

It is known that a very large pressure inlet and exhaust orifice is provided in order to pressurize and depressurize the pressure chamber to reduce overall cycle time. However, these attempts were not too successful due to seating problems of large orifices at higher pressure, also these valves must be forced open against the pressure in the tank at the point of the switchover between cycles, for example by the force generated by the spring of a snap over float mechanism.

Where the gas inlet and outlet valves are linked mechanically, the device that opens the gas inlet valve and closes the gas outlet valve is opposed by differential pressure between the pressure source and the tank for opening the inlet to commence a pumping phase, and between the tank and the vent for opening the outlet valve to commence filling phase. In a liquid dispenser vented to the atmosphere the pressure differential in each case is substantially equal to the difference between the gas supply pressure and ambient pressure or in a closed system the differential is between the pressures of the gas supply and the vent line.

If one chooses to enlarge the orifice size of the exhaust valve to speed or improve venting, the flow area of the exhaust valve body is increased. As a result, a correspondingly larger force is needed to open the exhaust valve against the pressure differential, because the same force per unit of area is applied to a larger area. It is not desirable to add heavier springs or other expensive mechanical features to the mechanism like bigger float. Larger float arm operates the respective valves. Likewise, larger valves are generally more expensive and technically demanding than smaller ones, particularly for high pressure applications.

What is needed is a means to reduce the flow restriction at the inlet and exhaust of a liquid dispenser that is to enlarge the exhaust orifice, without the drawbacks of a large valve including the need to obtain added mechanical opening force in the valve operating mechanism. Further, the valves structure should deal with the problem of pumping and venting steam such that the steam does not substantially slow down the venting of pressure or the inflow of water.

SUMMARY

Particularly, aspects of this invention relate to liquid dispenser that employs a fluid under pressure for motive power using gas or steam pressure to pump liquid condensate for removal or recovery of condensate in a steam system, heat exchanger or other pressurized apparatus.

More particularly, aspects of this invention relate to float-operated snap action valve actuating mechanisms for liquid dispensing system.

Still particularly, aspects of this invention relate to a multiple pressurizing and depressurizing ports operated by snap action valve actuating mechanism to a force that is divided in different time zones/instances.

According to certain embodiments, there is provided a liquid dispenser system comprising:

i. multiple valve actuator assembly for opening of the multiple pressurizing ports in a fraction of milliseconds through suitable arrangement of the valves, when the level of the fluid in the pressure chambers reaches to a predetermined upper level;

ii. a multiple valve actuator assembly for opening of the multiple depressurizing ports in a fraction of milliseconds through suitable arrangement of the valves, when the level of the fluid in the pressure chamber falls to a predetermined level;

iii. a multiple valve actuator assembly that ensures leak tight closing of depressurizing ports achieved through properly designed resilient elements which assists the seating of depressurizing valve on depressurization port; and iv. a buffer vessel in line with non-return valve of liquid inlet line to reduce the filling time of the dispensing cycle thereby increasing the dispensing capacity of the system.

BRIEF DESCRIPTION OF THE DRAWINGS

Example embodiments of the invention will now be described with reference to the accompanying drawings in which.

Figure 2:
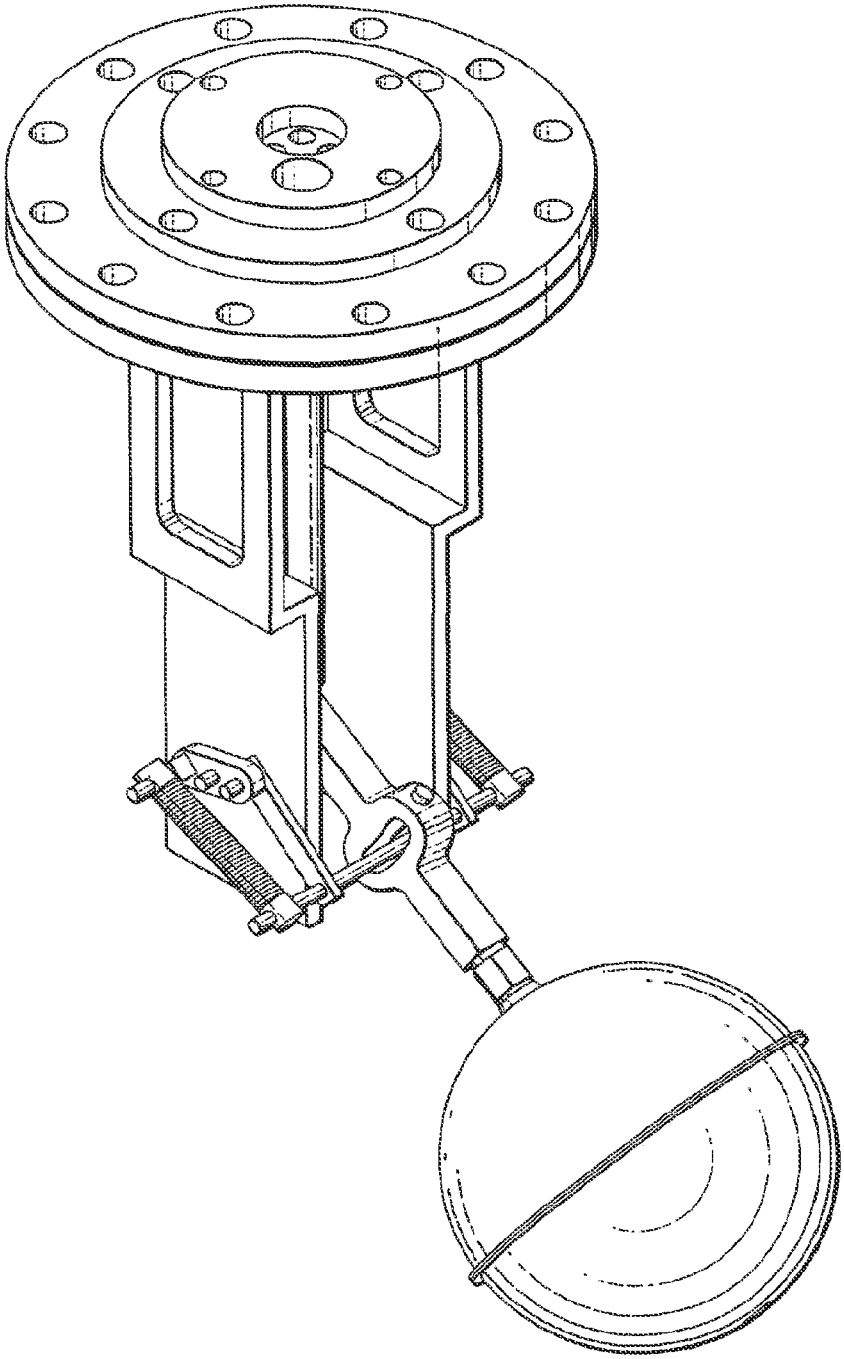
Figure 3:
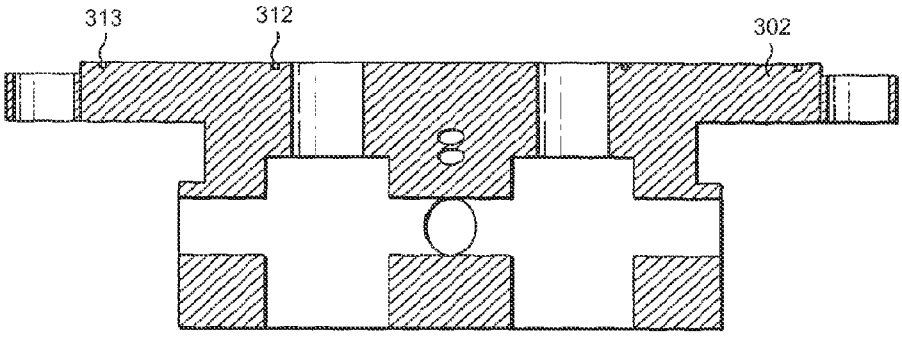
Figure 4:
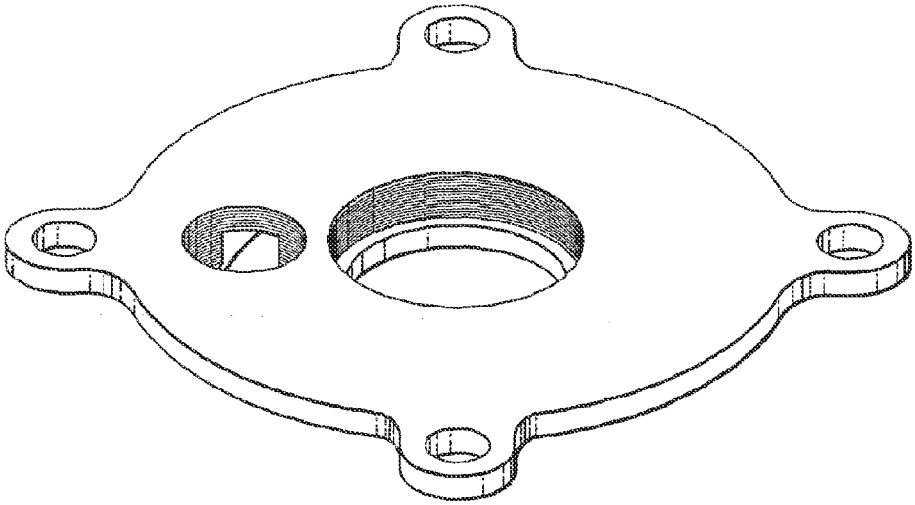
Figure 5:
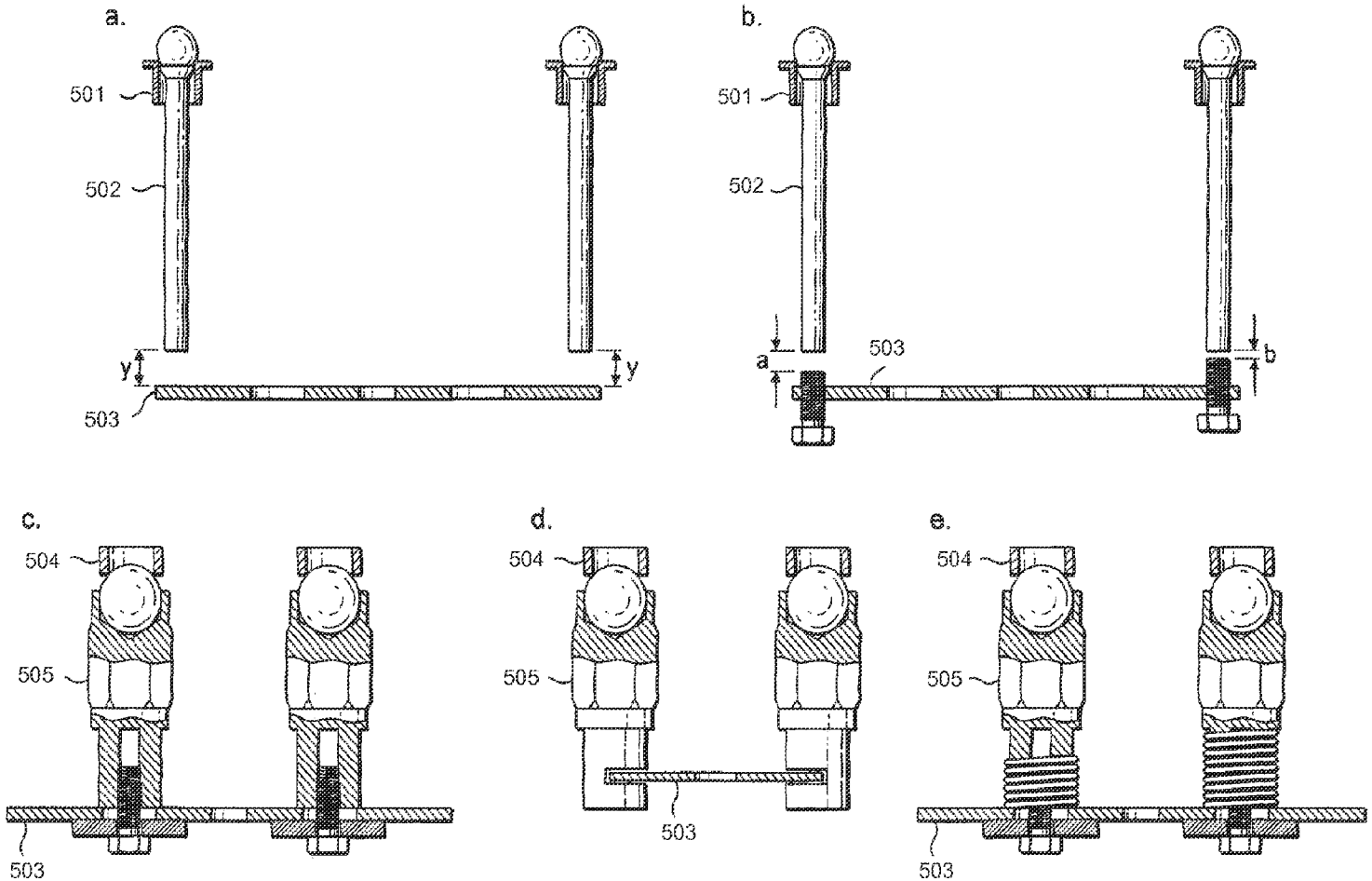
FIG. 5 (Prior Art)
Figure 6:
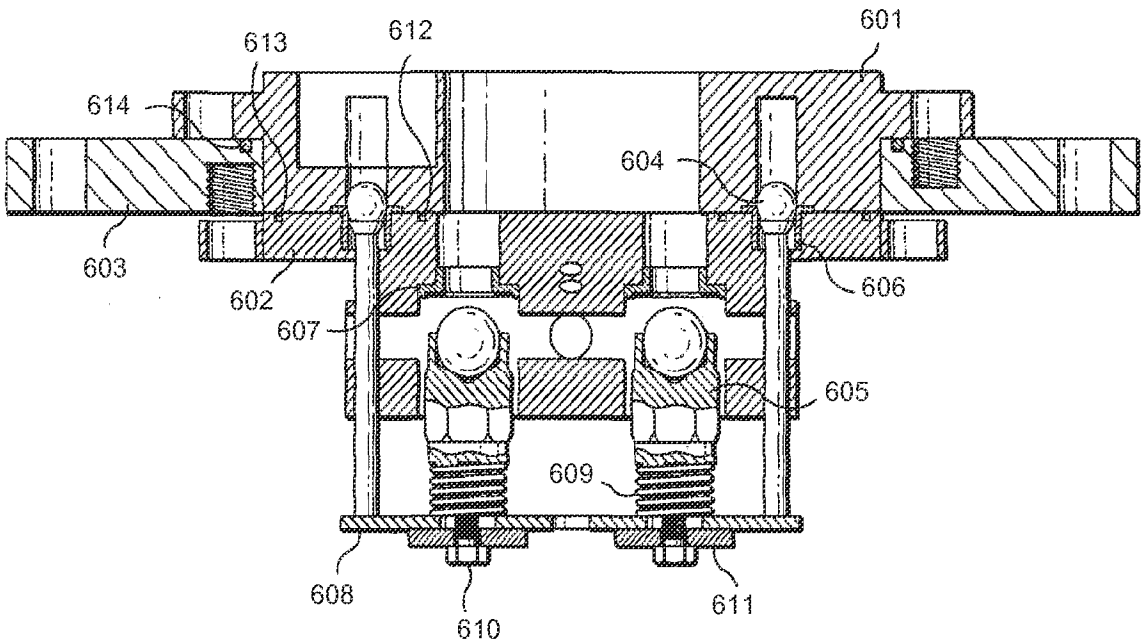

Numeral 101—Liquid Receiver;
Numeral 102—Isolation Valve;
Numeral 103—Strainer;
Numeral 104—Buffer Vessel;
Numeral 105—Liquid inlet non return valve;
Numeral 106—Depressurizing valve;
Numeral 107—Depressurizing valve port;
Numeral 108—Even distribution port;
Numeral 109—Pressurizing Valve;
Numeral 110—Pressurizing Valve port;
Numeral 111—Pressurizing media inlet manifold;
Numeral 112—Main connection port to pressure media;
Numeral 113—Support flange;
Numeral 114—Mounting flange;
Numeral 115—Liquid discharge non return valve;
Numeral 116—Resilient member;
Numeral 117—Fastners;
Numeral 118—Pressure Chamber;
Numeral 119—Float; and
Numeral 120—Snap action mechanism;

FIG. 2 of the accompanying drawings illustrates an example assembly of float operated snap action mechanism in accordance with one embodiment;

FIG. 3 of the accompanying drawings illustrates details of an example Valve Seat on which multiple pressurizing and pressurizing valves can be mounted in accordance with one embodiment;

FIG. 4 of the accompanying drawings illustrates an example pressurizing media inlet manifold in accordance with one embodiment;

FIG. 5 of the accompanying drawings illustrates an example delay providing arrangement in accordance with one embodiment;

FIG. 6 of the accompanying drawings illustrates an example assembly of inlet manifold, valve seat, its mounting arrangement along with valves, actuating disc and delay members in accordance with one embodiment where:

Numeral 601: Steam inlet manifold;
Numeral 602: Valve seat;
Numeral 603 Mechanism muting flange;
Numeral 604 Inlet valve;
Numeral 605 Exhaust valve;
Numeral 606 Inlet valve bush;
Numeral 607 Exhaust valve bush;
Numeral 608 Actuating disc;
Numeral 609 Exhaust valve spring;
Numeral 610 Set screw;
Numeral 611 washer;
Numeral 612 O-ring-1;
Numeral 613 O-ring-2; and
Numeral 614 O-ring-3; and FIG. 7 of the accompanying drawings illustrates an example exploded view of components in FIG. 6 in accordance with one embodiment.

DETAILED DESCRIPTION

Figure 1:
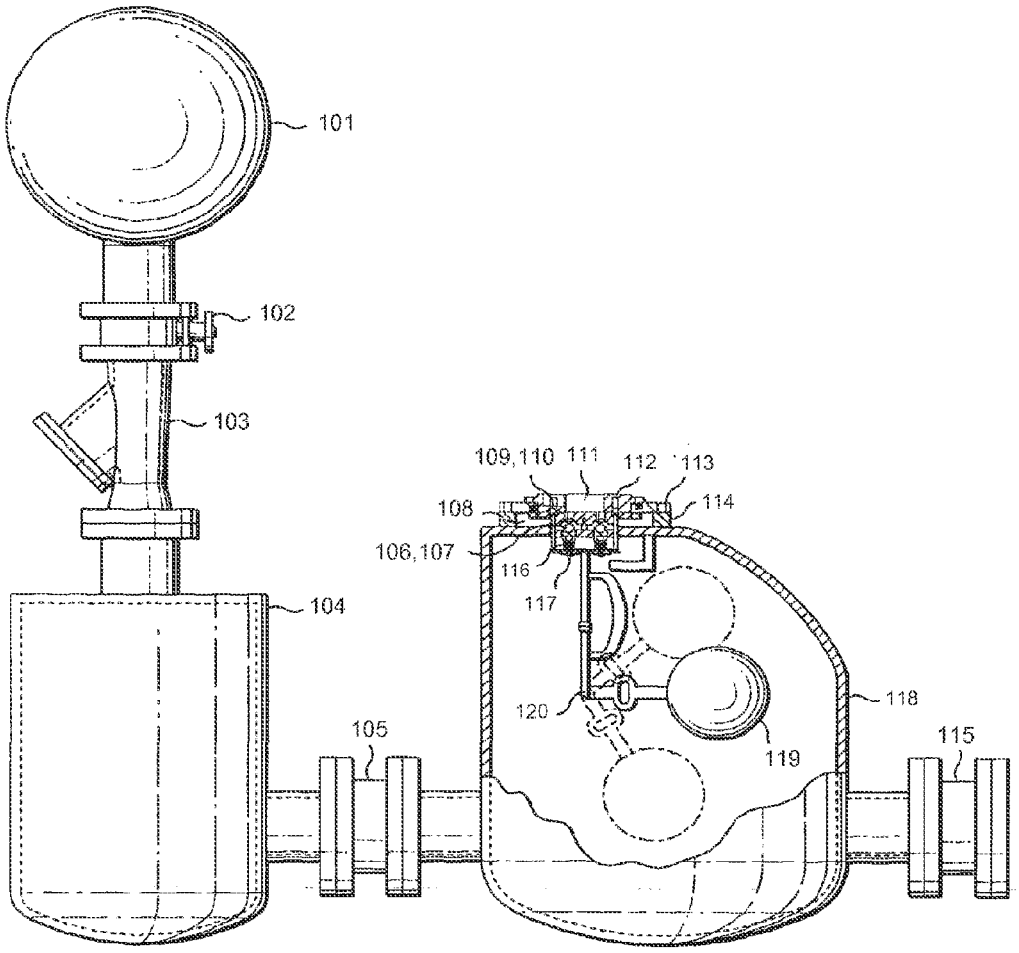
FIG. 1 of the accompanying drawings illustrates an illustrative liquid dispenser unit in totality in accordance with one embodiment where.

FIG. 1 of the accompanying drawings illustrates an illustrative embodiment of a liquid dispenser unit in, liquid to be pumped is received in receiver (FIG. 1, Numeral 101), this liquid flows through isolation valve (FIG. 1, Numeral 102), to strainer (FIG. 1, Numeral 103), to buffer vessel (FIG. 1, Numeral 104). When Pressure in the pressure chamber (FIG. 1, Numeral 118) is less than pressure in buffer vessel (FIG. 1, Numeral 104) the liquid flows from the buffer vessel (FIG. 1, Numeral 4) to the pressure chamber (FIG. 1, Numeral 118), through the non-return valve (FIG. 1, Numeral 105) which opens in the direction of the pressure chamber (FIG. 1, Numeral 118). As the liquid starts filling up in the pressure chamber (18), float (FIG. 1, Numeral 119) rises in the pressure chamber (18) at predefined liquid level, snap action takes place causing pressurizing valves (FIG. 1, Numeral 109) to open, the depressurizing valves (FIG. 1, Numeral 106) to close. This may happen simultaneously but the opening of all pressurizing valves (FIG. 1, Numeral 109) may not take place at the same instance. Delay provided by the adjusting fasteners (FIG. 1, Numeral 117) enables the pressurizing valves (109) operating in different time zones, though it happens in fraction of milliseconds at different instances.

In one embodiment, dividing opening of time zone is critical task as opening of all valves simultaneously is not possible with available force generated by snap action mechanism (FIG. 1, Numeral 120). Similarly if the depressurizing valves (FIG. 1, Numeral 106) do not seat simultaneously on the depressurization port (FIG. 1, Numeral 7), there is a chance of leakage. However, to ensure leak proof seating of depressurizing valve a resilient member (FIG. 1, Numeral 116) and fasteners may be tuned. The pressurizing media coming through pressurizing valve ports (FIG. 1, Numeral 110) is evenly distributed in pressure chamber (FIG. 1, Numeral 118) through even distribution port (FIG. 1, Numeral 108). This pressure media exerts the force on liquid surface pushing the liquid through non return discharge valve (FIG. 1, Numeral 115) to desired location. As liquid level goes down float (FIG. 1, Numeral 119) comes down. At particular point downward snap action takes place closing the pressurizing valves (FIG. 1, Numeral 109) against pressurizing port (FIG. 1, Numeral 111) and opening depressurizing valve (FIG. 1, Numeral 106). As pressure in pressure chamber (18) falls down liquid from buffer vessel (FIG. 1, Numeral 104) rushes to pump chamber (FIG. 1, Numeral 118) and cycle is repeated.

FIG. 5 of the accompanying drawings illustrates delay providing arrangement. FIG. 5*a* illustrates a mechanism of the prior art, wherein all valves operate simultaneously. FIG. 5*b* illustrates a mechanism of the prior art wherein all valves operate with a time delay. FIGS. 5*c* and 5*d* illustrates a mechanism of the prior art, wherein no measures are taken to avoid leaks or delays. FIG. 5*e* illustrates an example of a mechanism of one embodiment to ensure time delay and provide a leak proof assembly. Actuating disc (503) and depressurization seat (504) and depressurization valve (505) are shown.

Figure 7:
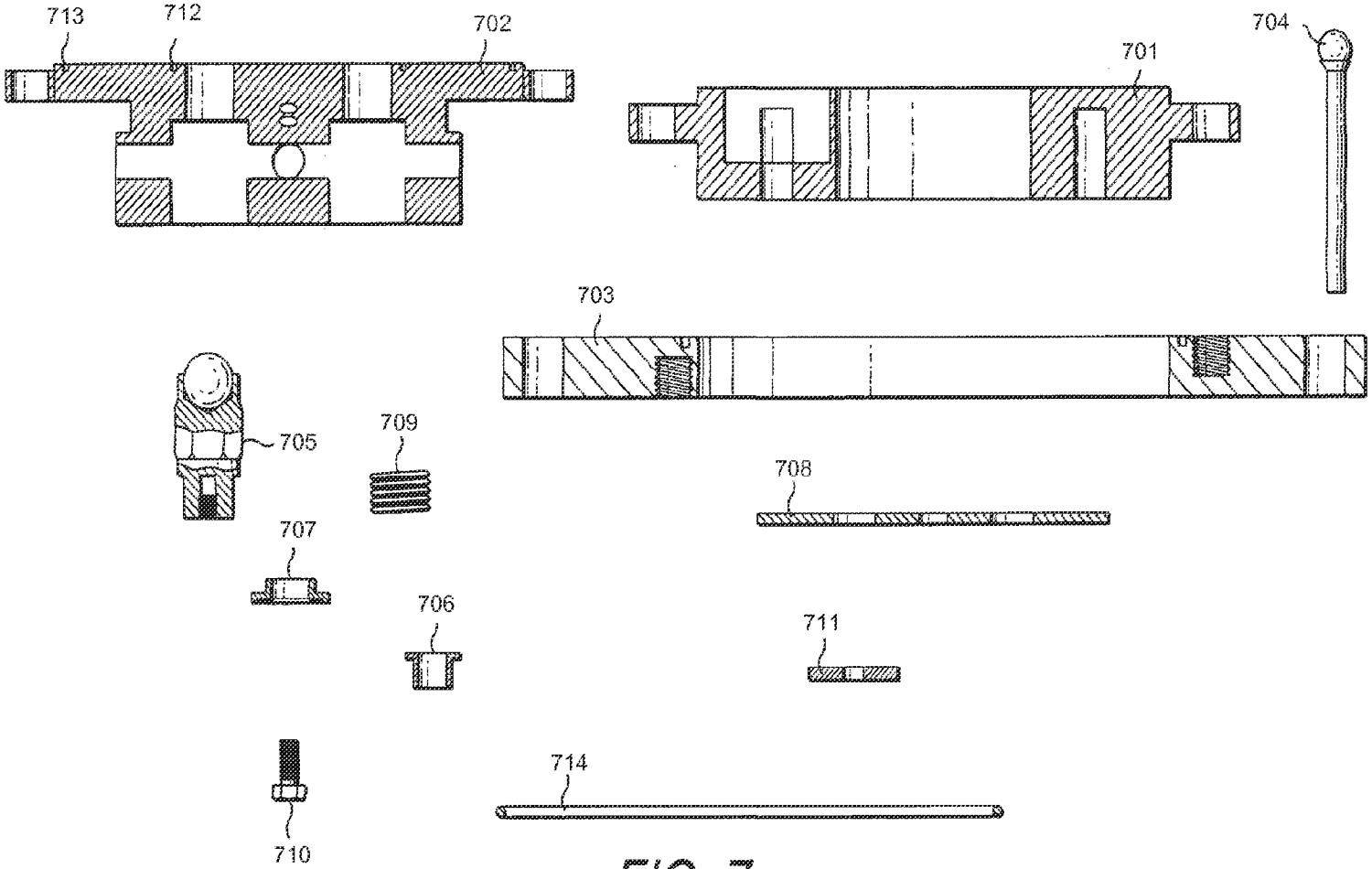

FIG. 6 and FIG. 7 provide more insights into the pressurized fluid inlets and related mechanisms. The pressurized fluid inlet manifold (FIG. 6, Numeral 601) gives passage for incoming pressurized media and it distributes the media equally inside pressurizing chamber coming through pressurizing ports.

The illustrated pressurized fluid inlet manifold (FIG. 6, Numeral 601) is shown as being fixed on mechanism mounting flange (FIG. 6, Numeral 603). Valve seat (FIG. 6, Numeral 602) holds the pressurizing valves (FIG. 6, Numeral 604) and depressurizing valves (FIG. 6, Numeral 605). Pressurizing ports (FIG. 6, Numeral 606) depressurizing ports (FIG. 6, Numeral 607) are fixed on valve seat (FIG. 6, Numeral 602). Mechanism mounting flange (FIG. 6, Numeral 603) is fixed on the pressure chamber Pressurized fluid inlet manifold (FIG. 6, Numeral 601) and is fixed on it. It also holds valve seat (FIG. 6, Numeral 602) from other side.

Pressurizing valves (FIG. 6, Numeral 604) controls the incoming pressurized media. These valves are actuated by an actuating disc (FIG. 6, Numeral 608). Depressurizing valves (FIG. 6, Numeral 605) kills the pressure inside pump chamber and is also actuated by an actuating disc (FIG. 6, Numeral 608). Actuating disc (FIG. 6, Numeral 608) is actuated by float operated snap action mechanism. Actuating disc (FIG. 6, Numeral 608) actuates the pressurizing valves (FIG. 6, Numeral 4) and depressurizing valves FIG. 6, Numeral 605), as well as holds these valves. Resilient member (FIG. 6, Numeral 609) gives the leak proof seating of depressurizing valve (FIG. 6, Numeral 605) in closed position. Fasteners (FIG. 6, Numeral 610) hold the depressurizing valve (FIG. 6, Numeral 605) with actuating disc at respective position. They also help to maintain delay in pressurizing valve opening. Washer (FIG. 6, Numeral 611) is used with set screw.

Isolation ring (FIG. 6, Numeral 612 and 613) is used in between pressurizing media inlet manifold (FIG. 6, Numeral 601) and valve seat (FIG. 6, Numeral 602). Isolation ring (FIG. 6, Numeral 612) separates pressurizing valves (FIG. 6, Numeral 604) and depressurizing valves (FIG. 6, Numeral 605). Isolation ring (FIG. 6, Numeral 613) prevents pressurizing media leakage to surrounding through Pressurized fluid inlet manifold. Isolation ring (FIG. 6, Numeral 614) Prevents leak from pressurizing chamber to surrounding through mechanism mounting flange (603)

Exemplary Advantages/Applications

One or more advantages may be realized through various embodiments of this disclosure. Advantages may include but are not limited to:

decrease filling time of a liquid dispenser by addition of buffer vessel in line with liquid inlet non return valve;

decrease pumping time of a liquid dispenser by addition of buffer vessel in line with liquid inlet non return valve;

decrease exhaust time of a liquid dispenser by multiple exhausts de-pressurizing valves;

decrease overall pumping cycle time of a liquid dispenser increasing capacity of the pump;

provide a liquid dispenser that employs a fluid under pressure;

employ a fluid under pressure for motive power, using gas or steam pressure to pump liquid condensate for removal or recovery of condensate in a steam system, heat exchanger or other pressurized apparatus;

provide a float operated snap action valve actuating mechanism for liquid dispensing system;

provide afloat-operated snap action valve actuating mechanisms where a pressure chamber is alternately filled and emptied in pressuring and depressurizing cycle by pump operation depending on level of liquid such as fuel, water, steam condensate etc. accumulating within the pressure chamber through buffer vessel;

provide a multiple valve actuator assembly for the multiple pressurizing ports in fraction of milliseconds through suitable arrangement of the valves, when the level of the fluid in the pressure chambers reaches to a predetermined level;

provide a multiple valve actuator assembly that provides opening of the multiple depressurizing ports in fraction of time through suitable arrangement of the valves, when the level of the fluid in the pressure chamber falls to a predetermined level;

provide a multiple valve actuator assembly that ensures leak tight closing of depressurizing ports achieved through properly designed resilient elements which assist the seating of depressurizing valves on depressurization port;

provide a buffer vessel in line with non-return valve of liquid inlet line to reduce the filling time of the dispensing cycle thereby increasing the dispensing capacity of the system;

provide a multiple pressurizing and depressurizing ports operated by snap action valve actuating mechanism which subject oppositely acting chamber pressurizing ports and depressurizing ports to a force that is divided in different time zones/instances by suitable arrangement in order to open and hold the valves;

provide an arrangement that improves the time of all phases of a liquid dispensing cycle and enhances the liquid dispensing capacity;

A buffer vessel in line with non-return valve of liquid inlet line to reduce the filling time of the dispensing cycle increased the dispensing capacity of the system.

Mechanism and arrangement of oppositely acting chamber pressurizing ports and depressurizing ports to a force which is divided in different time zones/instances by suitable arrangement of resilient member and/or fastening elements in order to open and hold the valves improved the time of all phases of a liquid dispensing cycle and enhanced the liquid dispensing capacity.

While considerable emphasis has been placed herein on the specific elements of example embodiments, it will be appreciated that many alterations can be made and that many modifications can be made in the preferred embodiment without departing from the principles of the invention. These and other changes to various embodiments as well as other embodiments of the invention will be apparent to those skilled in the art from the disclosure herein, whereby it is to be distinctly understood that the foregoing descriptive matter is to be interpreted merely as illustrative of the invention and not as a limitation.

The invention claimed is:

1. A liquid dispensing mechanism capable of achieving an increased inflow and an increased outflow rate, the mechanism comprising an inlet line configured to receive liquid from an external reservoir, and further configured to release a liquid via an outlet line, said mechanism comprising:

a pressure chamber configured to store liquid and provide a liquid level configured to fall or rise as a function of pressure;

a plurality of pressurizing ports arranged to provide pressurizing media to the pressure chamber and a plurality of depressurizing ports arranged to release pressurizing media from the pressure chamber;

a float member in said pressure chamber configured to sense the liquid level in the pressure chamber as a function of a position of said float member;

a multiple valve actuator assembly comprising a plurality of pressurizing valves for opening and closing the pressurizing ports and a plurality of depressurizing valves for opening and closing the depressurizing ports, wherein the multiple valve actuator assembly comprises a delay providing arrangement configured to provide a time-delay between at least one of:

(a) engaging subsequent depressurization valves; and disengaging subsequent pressurization valves; or (b) engaging subsequent depressurization valves; and disengaging subsequent depressurization valves; and a snap action valve actuating mechanism comprising fastener elements configured to actuate said multiple valve actuator assembly in correlation with position of said float member.

2. A mechanism as claimed in claim 1, wherein said mechanism includes an isolation valve configured to isolate the flow of the liquid into said mechanism from an external liquid reservoir.

3. A mechanism as claimed in claim 1, wherein the plurality of the depressurizing valves are configured to be actuated by an actuating disc to prevent a release of pressure outside of the pressure chamber during a pressurization/pumping cycle.

4. A mechanism as claimed in claim 1, wherein said depressurizing valves are configured to regulate an outflow of pressurized media from said pressure chamber.

5. A mechanism as claimed in claim 1, wherein said plurality of pressurizing valves of the multiple valve actuator assembly are configured to regulate the pressuring media provided to the pressure chamber.

6. A mechanism as claimed in claim 1, further comprising a liquid discharge non return valve fitted in line with said pressure chamber and before said outlet line configured to discharge liquid to a desired location and prevent back flow of the liquid into the pressurized chamber.

7. A mechanism as claimed in claim 3, further comprising a resilient member configured to provide a leak-proof seating of a depressurizing valve in a closed position during the pressurization/pumping cycle.

8. A mechanism as claimed in claim 7, further comprising a fastener configured to hold the depressurizing valve with the actuating disc at a pre-defined position.

9. A mechanism as claimed in claim 1, wherein at least two of the plurality of pressurizing ports and at least two of the plurality of depressurizing ports are created in a single valve seat, which may be formed as multiple valve seats mounted independently.

10. A mechanism as claimed in claim 1, wherein the multiple pressurizing valves are configured to achieve a time delay through suitable means of a fastening element.

11. A mechanism as claimed in claim 1 wherein, further comprising a resilient member, wherein the resilient member is configured to seat at least two of the plurality of depressurizing valves in a single valve seat, which may be formed as multiple valve seats mounted independently in order to provide a leak-proof joint.

12. A mechanism as claimed in claim 9, wherein the valve seat is configured to ensure a delay by providing seating ports at different heights.

13. A mechanism as claimed in claim 9, wherein the plurality of the depressurizing valves are configured to be actuated by an actuating disc to preventing a release of pressure outside of the pressure chamber during a pressurization/pumping cycle, wherein the valves seat is configured to balance the forces on actuating disc from the snap-action valve actuating mechanism.

14. A mechanism as claimed in claim 1, further comprising:

a buffer chamber configured to connect with said pressure chamber via at least one non-return valve, and further configured to store a liquid before the liquid flows from the buffer a chamber into said pressure chamber, in order to increase flow coefficient of the inlet line.

15. A mechanism as claimed in claim 14, wherein said mechanism includes a strainer in line with said buffer chamber configured to strain said liquid before it enters said buffer chamber.

16. A mechanism as claimed in claim 14, wherein said at least one non return valves comprises a liquid non-return valve configured to allow liquid to flow from the buffer chamber to the pressure chamber in the direction of the pressure chamber.

17. A mechanism as claimed in claim 14, wherein the buffer chamber is inline with at least one inlet to increase the flow co-efficient of the inlet line and reducing the pump filling time, wherein the buffer chamber is inline with the at least one non return valve of the liquid inlet line to reduce the filling time of a dispensing cycle and increase a dispensing capacity of the system.

* * * * *